US008584367B2

(12) United States Patent
Chu et al.

(10) Patent No.: US 8,584,367 B2
(45) Date of Patent: Nov. 19, 2013

(54) POCKETKNIFE WITH AN ASSISTED OPENING AND CLOSING MECHANISM

(76) Inventors: Hui-Tung Chu, New Taipei (TW); Jiun-Yu Chu, New Taipei (TW)

( * ) Notice: Subject to any disclaimer, the term of this patent is extended or adjusted under 35 U.S.C. 154(b) by 229 days.

(21) Appl. No.: 13/168,275

(22) Filed: Jun. 24, 2011

(65) Prior Publication Data

US 2012/0324738 A1 Dec. 27, 2012

(51) Int. Cl.
*B26B 3/06* (2006.01)

(52) U.S. Cl.
USPC ..... 30/151; 30/155; 30/160; 30/161

(58) Field of Classification Search
USPC ..... 30/151–164
See application file for complete search history.

(56) References Cited

U.S. PATENT DOCUMENTS

| | | | | | |
|---|---|---|---|---|---|
| 1,431,835 | A * | 10/1922 | Neft | 30/160 |
| 1,940,855 | A * | 12/1933 | Friedman | 279/24 |
| 4,083,110 | A * | 4/1978 | Goldin et al. | 30/155 |
| 4,868,985 | A * | 9/1989 | Rehm | 30/162 |
| 5,502,895 | A * | 4/1996 | Lemaire | 30/158 |
| 5,953,821 | A * | 9/1999 | Mearns | 30/161 |
| 5,966,817 | A * | 10/1999 | Lee | 30/162 |
| 6,305,085 | B1 * | 10/2001 | Stallegger et al. | 30/161 |
| 6,796,033 | B2 * | 9/2004 | Owoc | 30/162 |
| 7,080,457 | B2 * | 7/2006 | Sullivan | 30/160 |
| 7,246,441 | B1 * | 7/2007 | Collins | 30/160 |
| 7,249,417 | B2 | 7/2007 | Chu | |
| 7,536,788 | B2 * | 5/2009 | VanHoy et al. | 30/154 |
| 7,543,386 | B2 * | 6/2009 | Sullivan | 30/160 |
| 7,694,421 | B2 * | 4/2010 | Lin | 30/159 |
| 8,359,753 | B1 * | 1/2013 | Frazer | 30/158 |
| 2006/0168817 | A1 * | 8/2006 | Kao | 30/153 |
| 2007/0039190 | A1 * | 2/2007 | Hinderer | 30/153 |

* cited by examiner

*Primary Examiner* — Omar Flores Sanchez
(74) *Attorney, Agent, or Firm* — C. G. Mersereau; Nikolai & Mersereau, P.A.

(57) ABSTRACT

A pocketknife has a handle, a blade, an assistant assembly and a locking assembly. The handle has a cavity defined in the handle. The blade is mounted pivotally at one end of the handle. The assistant assembly is mounted on the handle, assists to extend the blade out or retract the blade in the cavity and has a dial, a biasing lever and a spring. The dial is mounted rotatably in the handle and is connected securely on a proximal end of the blade. The biasing lever is mounted in the handle and is mounted eccentrically and pivotally on the dial. The spring is mounted around the biasing lever and biases the biasing lever to rotate the dial in two rotational directions to retract or extend the blade. The assistant assembly assists the user to open or close the pocketknife.

7 Claims, 10 Drawing Sheets

POCKETKNIFE WITH AN ASSISTED OPENING AND CLOSING MECHANISM

BACKGROUND OF THE INVENTION

1. Field of the Invention

The present invention relates to a knife, and more particularly to a pocketknife that has an assistant assembly that works alternatively to assist a user to open and close the blade of a pocketknife with less strenuous effort.

2. Description of Related Art

Foldable knives are generally used to cut or whittle articles and are compact so they can be safely carried in a person's pocket.

A conventional pocketknife has a handle, a blade and a spring. The handle has an inside edge, an outside edge, a front end, a rear end and a longitudinal slot. The longitudinal slot is formed in the inside edge. The blade is attached pivotally to the front end of the handle, folds into the longitudinal slot in the handle for storage or extends from the front end for use and has a proximal end. The proximal end is pivotally attached to the front end of the handle. The spring is a leaf type spring, is mounted in the outside edge of the handle and abuts the blade to keep the blade closed when the blade is folded into the handle and to keep the blade open when the blade extends from the front of the handle. However, wearing of the proximal end of the blade and weakening of the spring may allow the blade to open when subjected to an inadvertent external impact, and the exposed blade may injure the person carrying the knife.

Furthermore, the inventor's previous invention of U.S. Pat. No. 7,249,417 discloses another pocketknife that allows the blade to pivot laterally out through one side surface thereof and has a lock mechanism to lock the blade in a folded or extending position. However, a user has to manually push the blade out all the way when extending out the blade due to lack of an assistant unfolding mechanism, which is laborious and disadvantages the use of the pocketknife.

To overcome the shortcomings, the present invention provides a pocketknife with an assistant assembly to mitigate or obviate the aforementioned problems.

SUMMARY OF THE INVENTION

The main objective of the invention is to provide a pocketknife that has an assistant assembly that works alternatively to assist a user to open and close the blade of a pocketknife with less strenuous effort.

A pocketknife in accordance with the present invention comprises a handle, a blade, an assistant assembly and a locking assembly. The handle has a cavity defined in the handle. The blade is mounted pivotally at one end of the handle. The assistant assembly is mounted on the handle, assists to extend the blade out or retract the blade in the cavity and has a dial, a biasing lever and a spring. The dial is mounted rotatably in the handle and is connected securely on a proximal end of the blade. The biasing lever is mounted in the handle and is mounted eccentrically and pivotally on the dial. The spring is mounted around the biasing lever and biases the biasing lever to rotate the dial in two rotational directions to retract or extend the blade. The assistant assembly facilitates users' operating the pocketknife.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
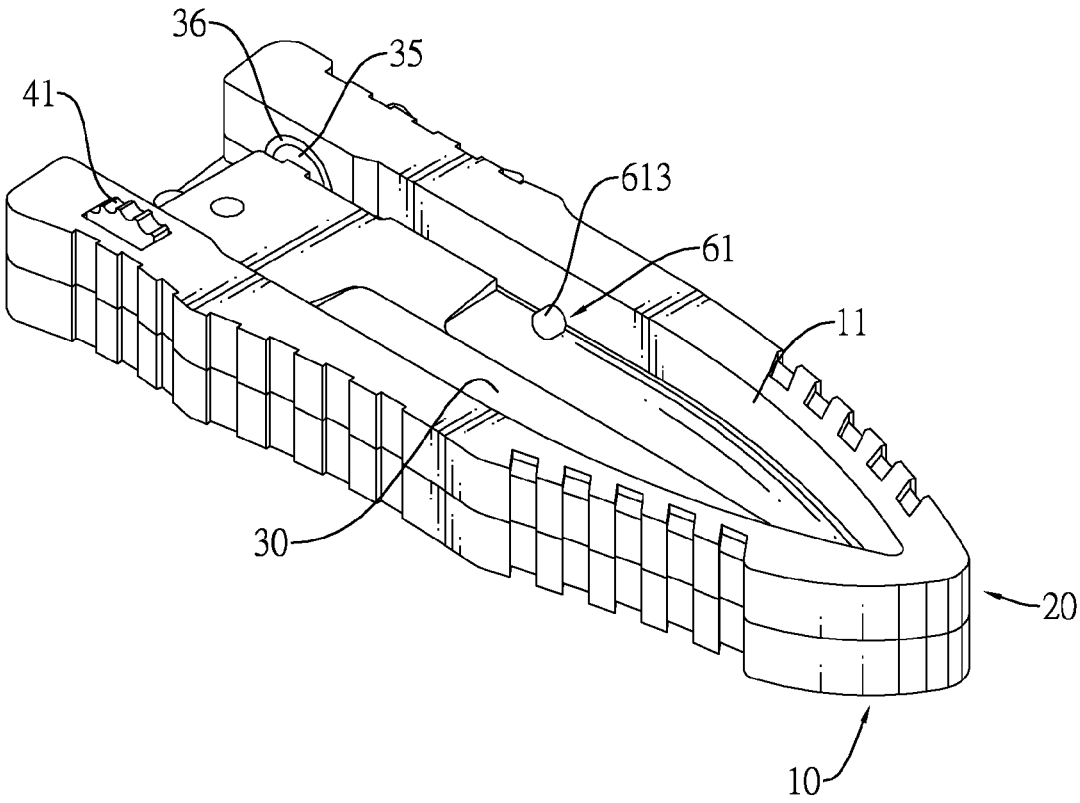
FIG. 1 is a perspective view of a pocketknife with an assistant assembly in accordance with the present application.
Figure 2:
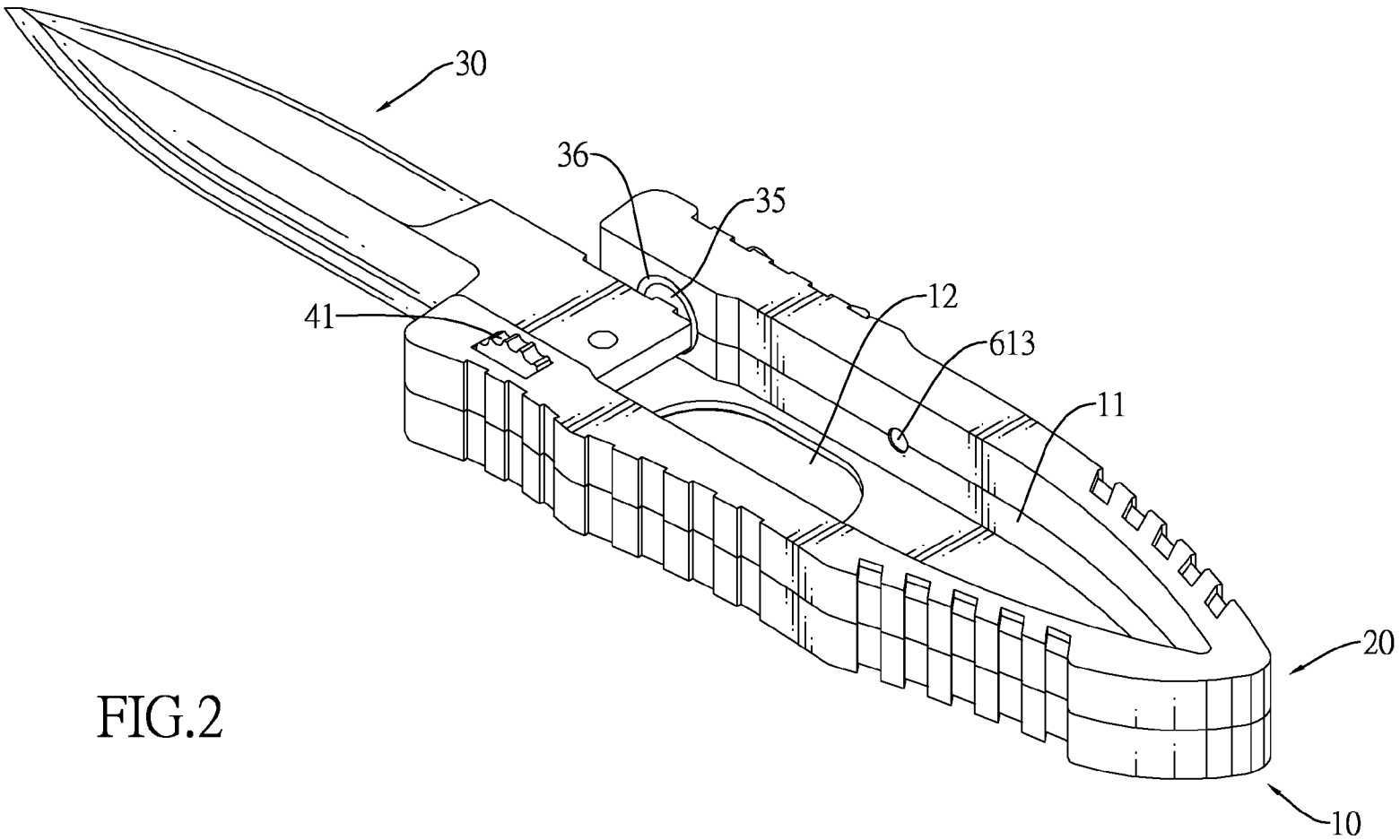
FIG. 2 is an operational perspective view of the pocketknife in FIG. 1 with a blade unfolded.
Figure 3:
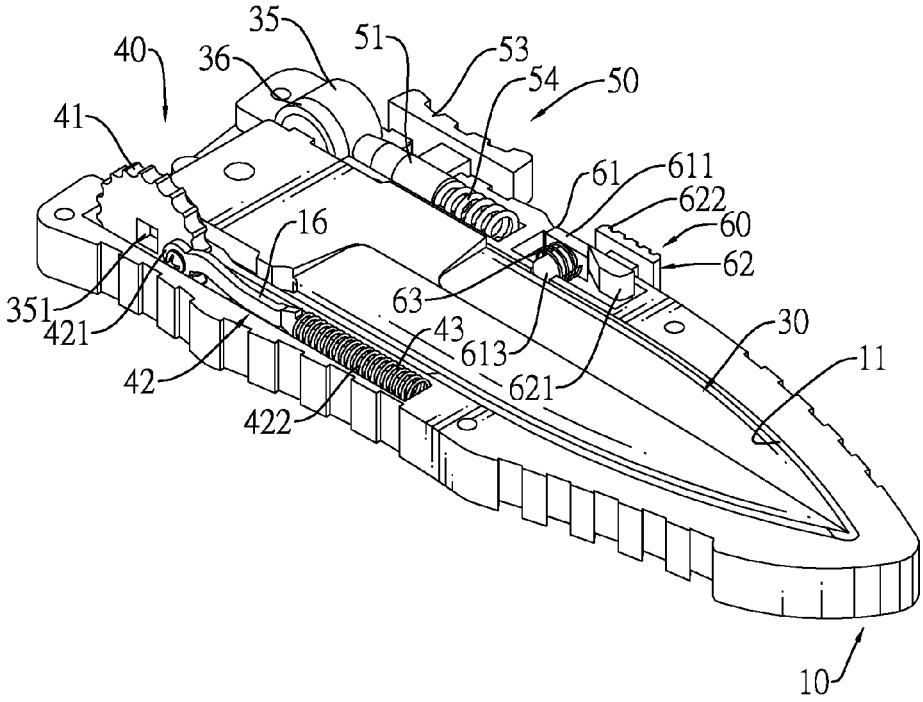
FIG. 3 is a perspective view of the pocketknife in FIG. 1 omitting a cover of a handle.

With reference to FIGS. 1 to 3, a pocketknife in accordance with the present application comprises a handle, a blade 30, an assistant assembly 40, a locking assembly 50 and a safety lock 60.

Figure 4:
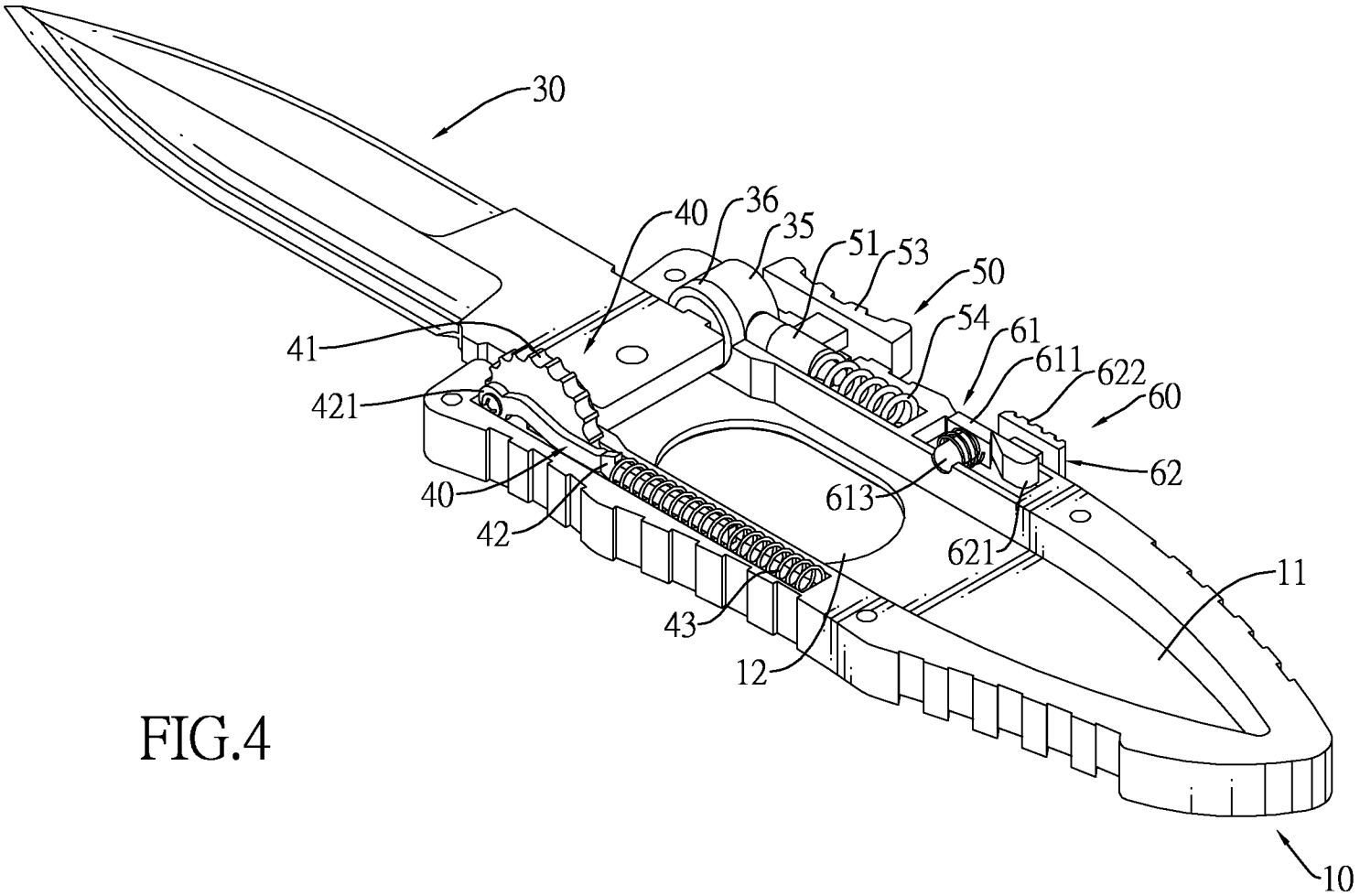
FIG. 4 is an operational perspective view of the pocketknife in FIG. 3.
Figure 5:
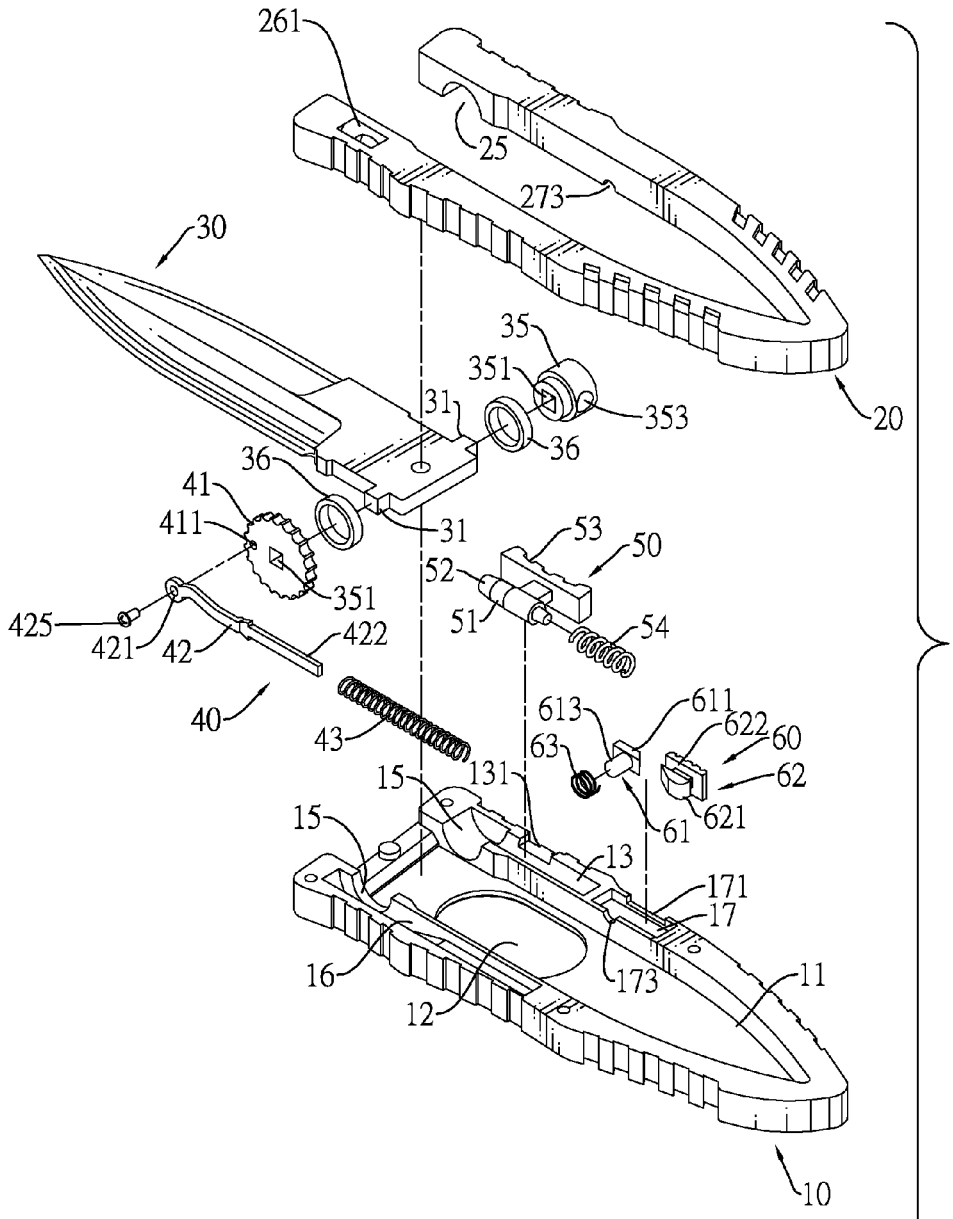
FIG. 5 is an exploded perspective view of the pocketknife in FIG. 1.
Figure 6:
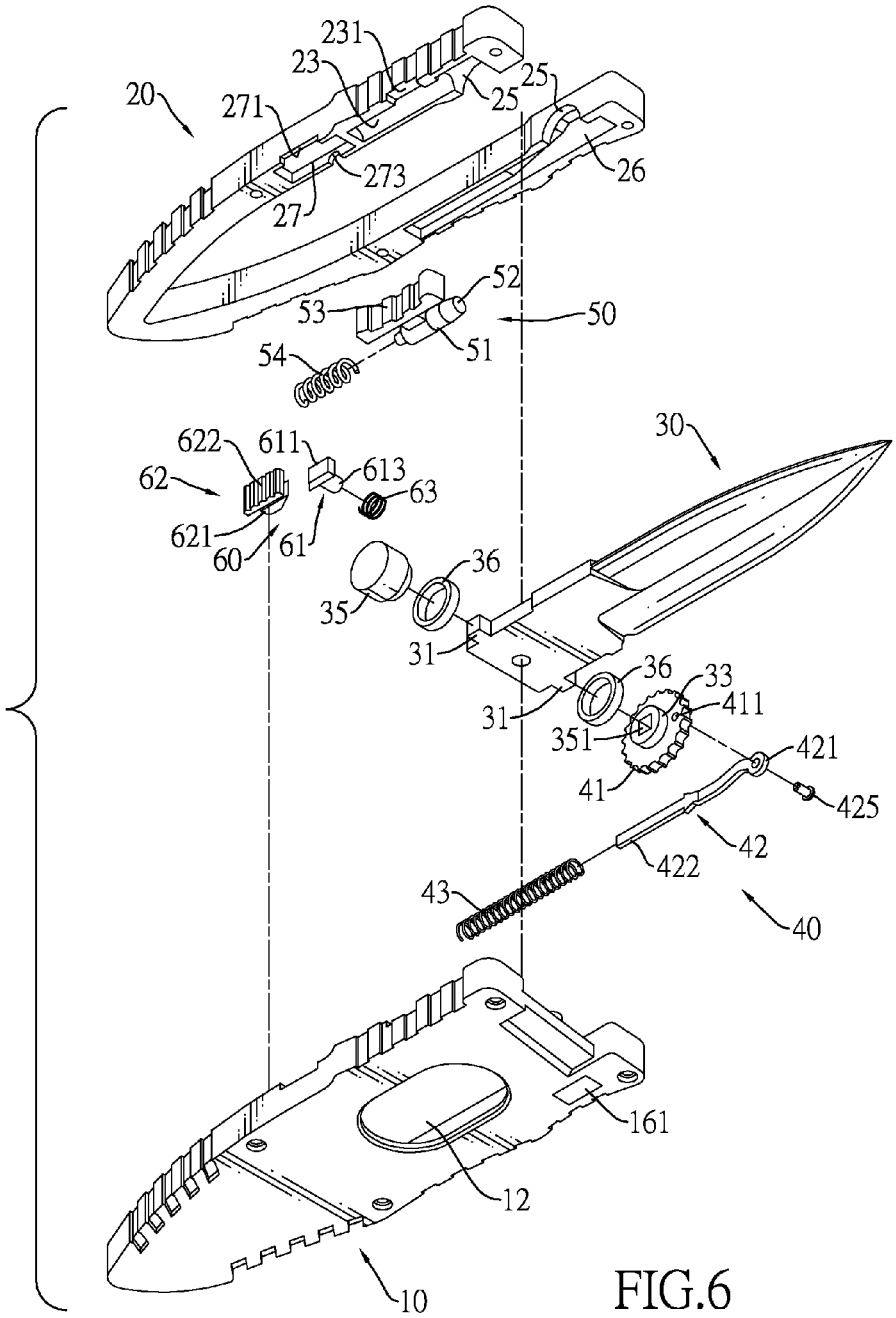
FIG. 6 is another exploded perspective view of the pocketknife in FIG. 1.

With further reference to FIGS. 4 to 6, the handle may be assembled by a blade seat 10 and a cover 20, has an inside end, an outside end, a seat side, an open side, a cavity 11, an opening 12, an assembling slot and two windows 161, 261 and may further have a slide slot, a limit slot and two pivot holes.

The cover 20 is U-shaped to facilitate unfolding the pocketknife.

The seat side may be adjacent to the blade seat 10.

The outside end is opposite to the inside end.

The open side is opposite to the seat side and may be adjacent to the cover 20.

The cavity 11 is defined through the open side, may be also defined adjacent to or in the seat side, may be defined through the cover 20 in the blade seat 10.

The opening 12 is defined through the seat side and communicates with the cavity 11. The opening 12 allows a user's finger to extend therein.

The assembling slot is defined in the handle and may be formed from two assembling slot halves 16, 26 that are defined respectively in the blade seat 10 and the cover 20.

The windows 161, 261 are defined oppositely in the handle, communicate with the assembling slot and may be defined respectively in the blade seat 10 and the cover 20 and communicate respectively with the assembling slot halves 16, 26.

The slide slot is defined in the handle, is opposite to the assembling slot, may be formed from two slide slot halves 13, 23 that are defined respectively in the blade seat 10 and the cover 20 and has a transverse passage. The transverse passage is defined through the handle, communicates with the slide slot and may be formed from two passage halves 131, 231 (171,271?).

The limit slot is defined in the handle, may be formed from two limit slot halves 17, 27 that are defined respectively in the blade seat 10 and the cover 20 and has an outside passage and an internal passage. The outside passage is defined through the handle and communicates with the limit slot and may be formed from two passage halves 171, 271. The internal passage is defined through the handle opposite to the outside passage, communicates with the cavity 11 and the limit slot and may be formed from two internal passage halves 173, 273.

The pivot holes are defined oppositely in the handle adjacent to the inside end and each pivot hole may be formed from two semicircular pivot slots 15, 25 that are defined respectively in the blade seat 10 and the cover 20.

The blade 30 is mounted pivotally on the inside end of the handle, is selectively accommodated in the cavity 11 or extends laterally out, has a proximal end and a point and may further have two pins 31 and two wheels 33,35.

The proximal end is mounted pivotally on the inside end of the handle.

The point is opposite to the proximal end.

The pins 31 are formed on and protrude oppositely out from the proximal end.

The wheels 33, 35 are unrotatably mounted respectively round the pins 31 and are rotatably mounted respectively in the pivot holes of the handle. Each wheel 33, 35 has a mounting hole 351 and a bearing 36. The mounting hole 351 is defined in the wheel 33, 35 and unrotatably receives one of the pins 31 of the blade 30. The bearing 36 is mounted rotatably around the wheel 33, 35. Furthermore, one of the wheels 35 is a locking wheel and further has an engaging element 353. The engaging element 353 is defined in the locking wheel and may be an engaging hole. However, unlike the conventional pocketknife disclosed by the previously filed patent which has two engaging holes, the current locking wheel 35 is modified to have only one engaging hole which receives the locking latch 52 in and locks the blade 30 only when the blade 30 extends out fully.

The assistant assembly 40 is mounted in the handle, assists to extend the blade 31 out or retract the blade 30 in the cavity 11 of the handle and has a dial 41, a biasing lever 42 and a spring 43.

The dial 41 is mounted rotatably in the assembling slot of the handle, extends out of the windows 161, 261, is mounted securely on one of the wheels 33 of the proximal end of the blade 30 and may be formed integrally on one of the wheels 33. Rotating the dial 41 synchronously pivots the blade 30. The dial 41 may have an outer edge, an eccentric mount 411 and friction teeth. The eccentric mount 411 is defined eccentrically on the dial 41 and may be an eccentric hole. The friction teeth are formed on the outer edge of the dial 41 so that a user may rotate the dial 41 easily by fingers or nails.

The biasing lever 42 is mounted slidably and capable of swaying in the assembling slot of the handle, is mounted pivotally and eccentrically on the dial 41 and has a mounting end 421 and a stem 422. The mounting end 421 is mounted pivotally and eccentrically on the dial 41, may be mounted pivotally on the eccentric mount 411 and may be connected to the eccentric hole by mounting a fastener 425 such as a bolt or rivet through the mounting end 421 in the eccentric hole. The stem 422 is formed opposite to the mounting end 421.

Figure 9:
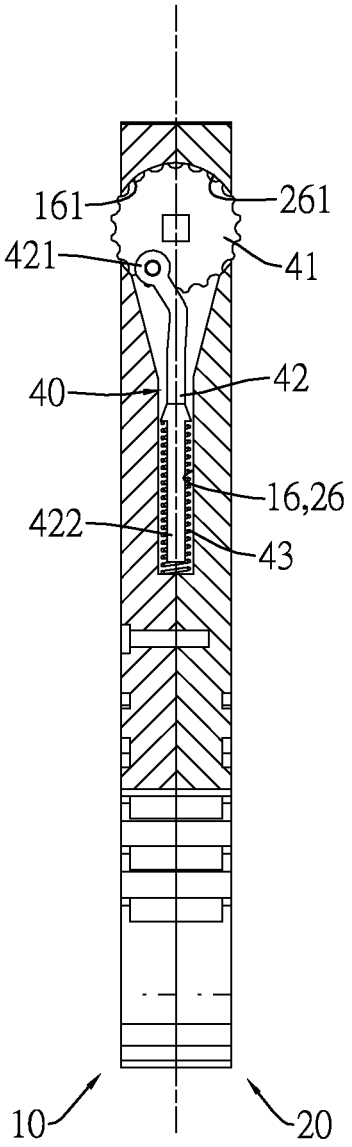
FIG. 9 is a bottom view of the pocketknife in FIG. 1.
Figure 10:
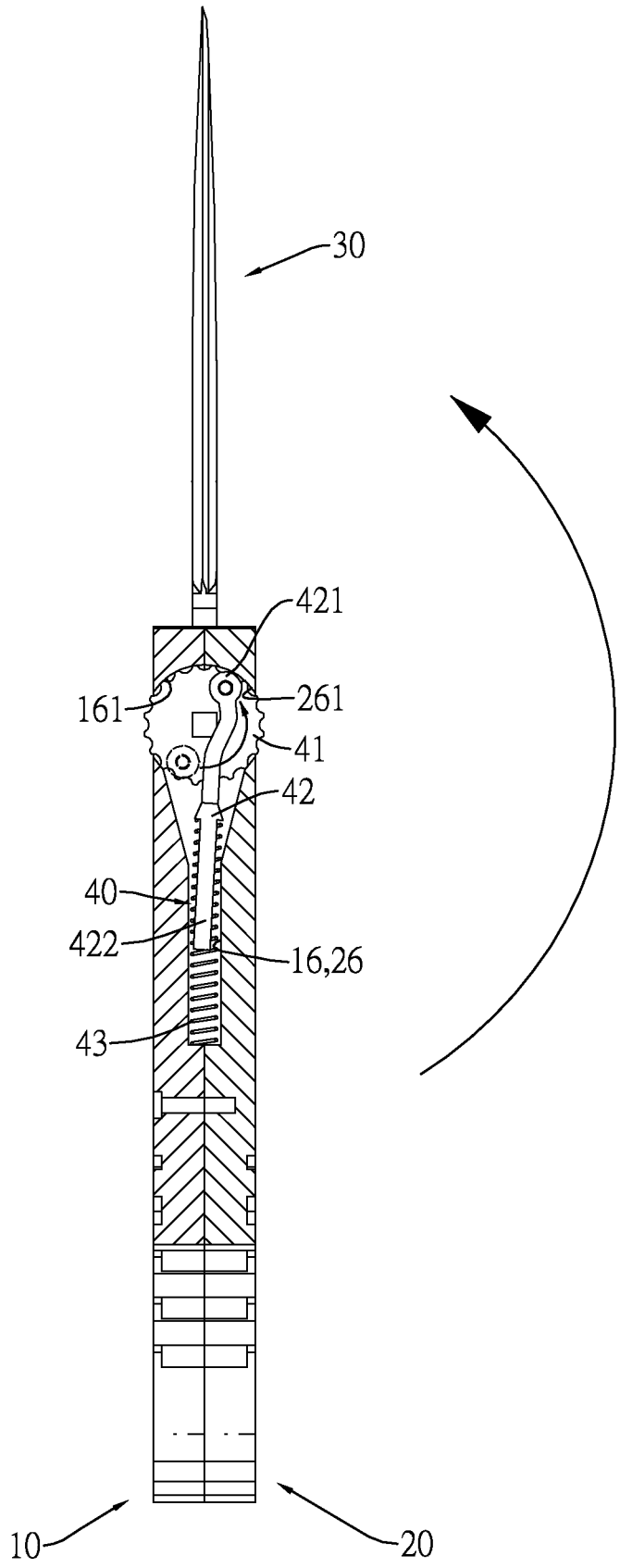
FIG. 10 is an operational bottom view of the pocketknife in FIG. 9 with the assistant unfolding wheel rotated to unfold the blade.

With reference to FIG. 9, the spring 43 is mounted around the stem 422 in the assembling slot of the handle and biases the mounting end 421 toward the dial 41 and near the seat side and blade seat 10 so that a resilient force from the spring 43 makes the dial tend to rotate clockwise to retract and keep the blade 30 in the cavity 11 of the handle when no external force is applied. With further reference to FIG. 11, manually rotating the dial 41 counterclockwise to move the mounting end 421 toward the open side and the cover 20 results in that the resilient force of the spring 43 drives the dial 41 to rotate counterclockwise until the blade 30 completely extends out.

The locking assembly 50 is mounted on the handle opposite to the assistant assembly 40, selectively locks and holds the pocketknife in an unfolding configuration and has a slide 51, a knob 53 and a biasing spring 54.

The slide 51 is mounted slidably in the slide slot of the handle and has a latch 52 formed on the slide 51, selectively engages the engaging element 353 of the locking wheel and may selectively extend in the engaging hole.

The knob 53 is formed on the slide 51, extends out through the transverse passage and is exposed out of the handle to facilitate the user's driving the slide 51.

The biasing spring 54 is mounted in the slide slot of the handle and biases the slide 51 toward the locking wheel so that the latch 52 on the slide 51 engages the engaging element 353 of the locking wheel when the blade 30 completely extends out of the handle. Therefore, the locking assembly 50 is capable of securely and stably holding the blade 30 at unfolding configuration of the pocketknife without inadvertently pivoting.

The safety lock 60 is mounted on the handle, selectively limits the blade 30 in the cavity 11 and has a locking member 61, a spring 63 and a switch 62.

The locking member 61 is mounted transversely slidably in the limit slot of the handle and has a first flattop wedge 611 and a locking pin 613. The first flattop wedge 611 is mounted in the limit slot. The locking pin 613 is formed on and protrudes from the first flattop wedge 611, is mounted slidably through the internal passage and selectively extends in the cavity 11 to limit and lock the blade 30 in the cavity 11.

The spring 63 is mounted around the locking pin 613 and biases the locking pin outward to release the blade 30 when no external force is further applied.

The switch 62 is mounted longitudinally slidably in the limit slot of the handle, selectively drives the locking member 61 to lock the blade 30 in the cavity 11 and has a second flattop wedge 621 and a tab 622.

The second flattop wedge 621 is mounted slidably in the limit slot of the handle and selectively engages the first flattop wedge 611 of the locking member 61 to extend the locking pin 613 in the cavity 11.

The tab 622 is formed on the second flattop wedge 621, extends out through the outside passage and is exposed out of the handle to facilitate the user's driving the switch 62.

Figure 7:
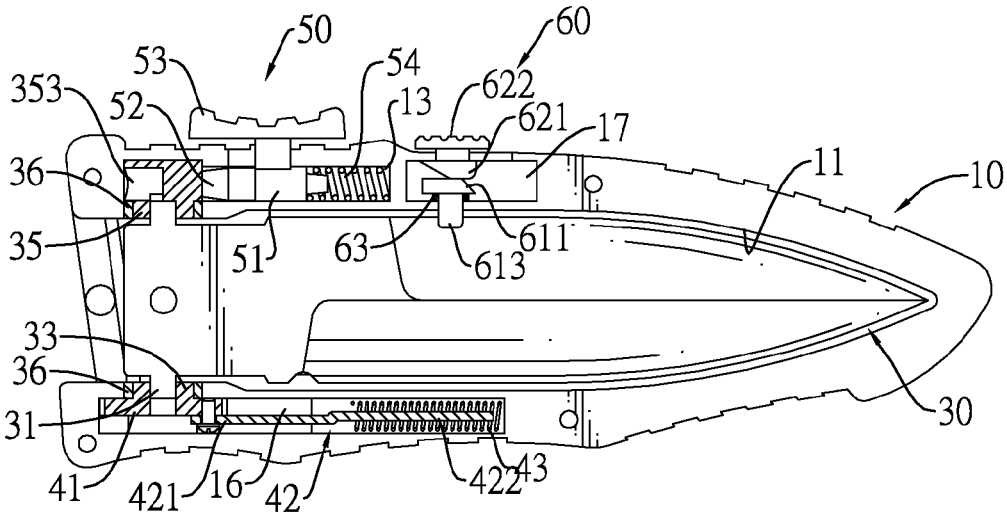
FIG. 7 is an operational side view of the pocketknife in FIG. 7 with a locking assembly unlocked.

With further reference to FIG. 7, when the pocketknife is at a folding configuration, the assistant assembly 40 creates a bias towards closure to the blade 30 and keeps blade 30 to remain folded in the cavity 11 securely. In addition, the safety lock 60 locks the blade 30 to prevent the blade 30 from inadvertently jumping out. The mounting end 421 of the biasing lever 42 is located substantially at the position of seven o'clock of the dial 41.

Figure 8:
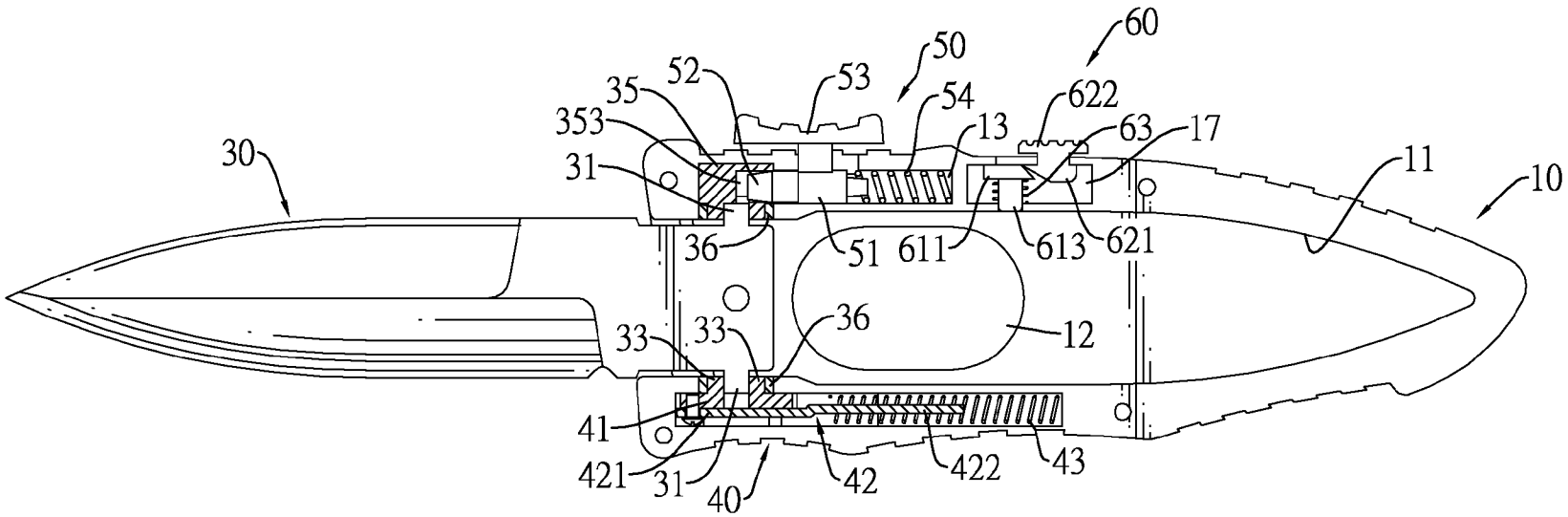
FIG. 8 is an operational side view of the pocketknife in FIG. 8 with the locking assembly locked and a safety lock unlocked.

With further reference to FIGS. 8 and 9, to unfold the pocketknife, the user must manually push the blade 30 against the clockwise resilient force from the assistant assembly 40 powered by the spring 43 by extending a finger through the opening 12 of the handle. When the user overcomes the resistance created from a bias towards closure and that is when mounting end 421 of the biasing lever 42 moves through the location of six o'clock relative to the dial 41, the assisted unfolding assembly 40 powered by the spring 43 then turns to provide an assistant resilient force helping rotate the dial 41 counterclockwise and thus accelerates the extension of the blade 30, as shown in FIG. 9. Alternatively, the user may use his/her finger to manually counterclockwise rotate the dial 41 to extend the blade 30 out. A manual rotation performed by a user is needed to activate the dial 41 to release the resilient force of the spring 43 around the biasing lever 42 so that the assistant assembly 40 will then complete the rest of actions assisting and unfolding the blade 30 out of the handle.

On the other hand, to fold or close the blade 30 into the handle, The user must firstly disengage the lock 50 and then push the blade clockwise and at this time the synchronizing movements of the dial 41, biasing lever 42 also take place. Once the mounting end 421 of the biasing lever 42 moves over the six o'clock relative to the dial 41, the resilient force becomes clockwise and assists to help retract the blade 30 into the handle.

The assistant assembly 40 assisting users to extend out the blade 30 only requires the user to slightly rotate the dial 40 or lightly push the blade 30 so is laborsaving and convenient. The unfolding assembly 40 also creates a bias towards closure when the blade 30 is at folded configuration and tends to remain the blade closed and sits securely in the handle. In addition, the safety lock 60 provides second safety insurance and prevents the blade 30 from inadvertently jumping out to cut the user.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A pocketknife comprising:

a handle having an inside end, an outside end, a seat side, an open side being opposite to the seat side, and the handle further having a cavity defined through the open side;

an opening defined through the seat side and communicating with the cavity; and an assembling slot defined in the handle;

a blade mounted pivotally on the inside end of the handle, selectively accommodated in the cavity or extending laterally and having a proximal end mounted pivotally on the inside end of the handle; and a point being opposite to the proximal end;

an assistant assembly mounted in the handle, assisting to extend the blade out or retract the blade in the cavity of the handle and having a dial mounted rotatably in the assembling slot of the handle, mounted securely on the proximal end of the blade so that rotating the dial synchronously pivots the blade;

a biasing lever mounted slidably and being capable of swaying in the assembling slot of the handle, mounted pivotally and eccentrically on the dial and having a mounting end mounted pivotally and eccentrically on the dial; and a stem being opposite to the mounting end; and a spring mounted around the stem in the assembling slot of the handle and biasing the mounting end of the biasing lever toward the dial and near the seat side so that the dial is forced to rotate in a rotational direction tending to retract the blade in the cavity when no external force is applied; wherein manually rotating the dial reversely to move the mounting end of the biasing lever toward the open side of the handle extends the blade out of the handle; and a locking assembly mounted on the handle and selectively holding the pocketknife in an unfolding configuration;

wherein the handle further has two windows defined oppositely in the handle; and wherein the dial extends out of the windows.

2. The pocketknife as claimed in claim 1, wherein the dial has an outer edge and an eccentric mount defined eccentrically on the dial; and the mounting end of the biasing lever is mounted pivotally on the eccentric mount.

3. The pocketknife as claimed in claim 2, wherein the eccentric mount is an eccentric hole; and the mounting end of the biasing lever is connected to the eccentric hole by mounting a fastener through the mounting end in the eccentric hole of the dial.

4. The pocketknife as claimed in claim 3, wherein the handle further has two pivot holes defined oppositely in the handle adjacent to the inside end; and the blade further has two pins formed on and protruding oppositely out from the proximal end; and two wheels unrotatably mounted respectively round the pins and rotatably mounted respectively in the pivot holes of the handle.

5. The pocketknife as claimed in claim 4, wherein the handle further has a slide slot defined in the handle opposite to the assembling slot and having a transverse passage defined through the handle and communicating with the slide slot;

one of the wheels is a locking wheel and has an engaging element; and the locking assembly has a slide mounted slidably in the slide slot of the handle and having a latch formed on the slide and selectively engaging the engaging element of the locking wheel;

a knob formed on the slide, extending out through the transverse passage and exposed out of the handle; and a biasing spring mounted in the slide slot of the handle, and biasing the slide toward the locking wheel so that the latch on the slide engages the engaging element of the locking wheel when the blade completely extends out of or retracts in the handle.

6. The pocketknife as claimed in claim 5, wherein the handle further has a limit slot defined in the handle and having an outside passage defined through the handle and communicating with the limit slot; and an internal passage defined through the handle and communicating with the cavity and the limit slot;

a safety lock is mounted on the handle, selectively limits the blade in the cavity and has a locking member mounted transversely slidably in the limit slot of the handle and having a first flattop wedge mounted in the limit slot; and a locking pin formed on and protruding from the first flattop wedge, mounted slidably through the internal passage and selectively extending in the cavity to lock the blade in the cavity;

a spring mounted around the locking pin and biasing the locking pin outward to release the blade; and a switch mounted longitudinally slidably in the limit slot of the handle, selectively driving the locking member to lock the blade in the cavity and having a second flattop wedge mounted slidably in the limit slot of the handle and selectively engaging the first flattop wedge of the locking member to extend the locking pin in the cavity; and a tab formed on the second flattop wedge, extending out through the outside passage and exposed out of the handle.

7. The pocketknife as claimed in claim 6, wherein the handle is assembled by a blade seat being adjacent to the seat side and a cover being U-shaped and adjacent to the open side;

the assembling slot is formed from two assembling slot halves defined respectively in the blade seat and the cover;

the slide slot is formed from two slide slot halves defined respectively in the blade seat and the cover;

the limit slot is formed from two limit slot halves defined respectively in the blade seat and the cover;

the outside passage is formed from two passage halves defined respectively in the blade seat and the cover;

the internal passage is formed from two passage halves defined respectively in the blade seat and the cover; and each pivot hole is formed from two semicircular pivot slots defined respectively in the blade seat and the cover.

* * * * *